US012359530B2

(12) United States Patent
Al Arji

(10) Patent No.: US 12,359,530 B2
(45) Date of Patent: Jul. 15, 2025

(54) METHOD TO MAXIMIZE OIL RECOVERY OF AN OIL AND GAS FIELD VIA OPTIMIZATION OF INFLOW CONTROL VALVE AND CHOKE VALVE SETTINGS USING MACHINE LEARNING

(71) Applicant: SAUDI ARABIAN OIL COMPANY, Dhahran (SA)

(72) Inventor: Faisal M. Al Arji, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 420 days.

(21) Appl. No.: 17/823,783

(22) Filed: Aug. 31, 2022

(65) Prior Publication Data

US 2024/0068325 A1 Feb. 29, 2024

(51) Int. Cl.
*E21B 34/02* (2006.01)
*E21B 43/12* (2006.01)

(52) U.S. Cl.
CPC ..... *E21B 34/025* (2020.05); *E21B 43/12* (2013.01); *E21B 2200/20* (2020.05)

(58) Field of Classification Search
CPC ..... E21B 2200/20; E21B 2200/22; E21B 34/025; E21B 47/10; E21B 34/16; E21B 43/12; F24F 13/1426; F24F 2013/1433; F24F 2013/1473; F24F 2013/205; F24F 8/108; F24F 8/80
USPC ..... 700/282; 166/250.15
See application file for complete search history.

(56) References Cited

U.S. PATENT DOCUMENTS

| | | | | |
|---|---|---|---|---|
| 10,677,035 | B2 | 6/2020 | Balan et al. | |
| 2016/0273315 | A1* | 9/2016 | Carvajal | E21B 43/12 |
| 2016/0298445 | A1* | 10/2016 | Al-Khalifa | G01F 1/66 |
| 2016/0312552 | A1 | 10/2016 | Early et al. | |
| 2016/0356125 | A1 | 12/2016 | Bello et al. | |
| 2016/0369590 | A1 | 12/2016 | Tonkin et al. | |
| 2017/0177761 | A1* | 6/2017 | Early | E21B 41/00 |
| 2017/0336811 | A1 | 11/2017 | Stone et al. | |
| 2020/0362670 | A1* | 11/2020 | Alanazi | E21B 41/00 |
| 2020/0362674 | A1* | 11/2020 | Alanazi | E21B 41/00 |
| 2020/0362697 | A1 | 11/2020 | Alanazi et al. | |
| 2021/0148196 | A1* | 5/2021 | Bukhamseen | E21B 41/0035 |
| 2022/0214474 | A1* | 7/2022 | Nistala | E21B 47/10 |
| 2024/0076953 | A1* | 3/2024 | Trifol | E21B 34/025 |

FOREIGN PATENT DOCUMENTS

| | | | |
|---|---|---|---|
| CN | 113874598 | A | 12/2021 |
| WO | 2021101879 | A1 | 5/2021 |
| WO | 2021206565 | A1 | 10/2021 |

* cited by examiner

*Primary Examiner* — Chun Cao
(74) *Attorney, Agent, or Firm* — Osha Bergman Watanabe & Burton LLP

(57) ABSTRACT

A method to optimize an oil and gas field, including receiving oil and gas field device data from a plurality of devices disposed throughout the oil and gas field, where at least one device of the plurality of devices monitors oil and gas production. The method further includes processing, by a computer processor, the device data to determine optimal inflow control valve (ICV) and choke valve settings, adjusting the ICV and choke valve settings to the optimal ICV and choke valve settings, and validating that the optimal ICV and choke valve settings optimize oil and gas production with the at least one device that monitors oil and gas production.

19 Claims, 7 Drawing Sheets

METHOD TO MAXIMIZE OIL RECOVERY OF AN OIL AND GAS FIELD VIA OPTIMIZATION OF INFLOW CONTROL VALVE AND CHOKE VALVE SETTINGS USING MACHINE LEARNING

BACKGROUND

The extraction and production of oil and gas from a well, or an oil and gas field composed of at least one well, is a complex process. Over the lifecycle of the oil and gas field many decisions will be taken in order to meet both short and long term goals and to extend the life cycle of a well. In general, optimization of an oil and gas field seeks to maximize hydrocarbon recovery while minimizing cost, wherein cost is accrued through the allocation of resources and energy. Additionally, oil and gas field optimization seeks to mitigate the production of process byproducts, such as water or acidic gases like $CO_2$ and $H_2S$.

In other words, optimization refers to the various activities of measuring, modelling, and taking actions to augment productivity of an oil and gas field. Optimization activities may include, or affect: field exploration, subsurface modelling, preliminary reservoir simulations, well-bore trajectory planning, and completions.

A completed and producing oil and gas field is composed of many components and sub-processes, both above and below the surface of the Earth. A plurality of oil and gas field devices are disposed at various locations throughout the oil and gas field. These devices include sensors and controllers which monitor and govern the behavior of the components and sub-processes of the oil and gas field. The productivity of the oil and gas field is directly affected, and may be altered, by the devices. Generally, complex interactions between oil and gas field components and sub-processes exist such that configuring field devices for optimal production is a difficult and laborious task. Further, the state and behavior of oil and gas fields is transient over the lifetime of the oil and gas field requiring continual changes to field devices to enhance production.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One or more embodiments disclosed herein generally relate to a method to optimize an oil and gas field. The method includes receiving oil and gas field device data from a plurality of devices disposed throughout the oil and gas field, where at least one device of the plurality of devices monitors oil and gas production. The method further includes processing, by a computer processor, the device data to determine optimal inflow control valve (ICV) and choke valve settings, adjusting the ICV and choke valve settings to the optimal ICV and choke valve settings, and validating that the optimal ICV and choke valve settings optimize oil and gas production with the at least one device that monitors oil and gas production.

One or more embodiments disclosed herein generally relate to a non-transitory computer readable medium storing instructions executable by a computer processor. The instructions include functionality for receiving oil and gas field device data from a plurality of devices disposed throughout an oil and gas field, where at least one device of the plurality of devices monitors oil and gas production, processing the device data to determine optimal inflow control valve (ICV) and choke valve settings, and returning the optimal ICV and choke valve settings.

One or more embodiments disclosed herein generally relate to a system. The system includes an oil and gas field, a plurality of devices disposed throughout the oil and gas field, where at least one device from the plurality of devices is configured to measure oil and gas production of the oil and gas field. The plurality of devises includes, at least, a plurality of inflow control valves (ICVs), and a plurality of choke valves. The system further includes a computer communicably connected to the plurality of devices. The computer includes one or more computer processors and a non-transitory computer readable medium storing instructions executable by a computer processor. The instructions include functionality for receiving oil and gas field device data from the plurality of devices, processing the device data to determine optimal inflow control valve (ICV) and choke valve settings, adjusting the ICV and choke valve settings to the optimal ICV and choke valve settings, and validating that the optimal ICV and choke valve settings optimize oil and gas production with the device that monitors oil and gas production.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology.

Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "acoustic signal" includes reference to one or more of such acoustic signals.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

Figure 1:
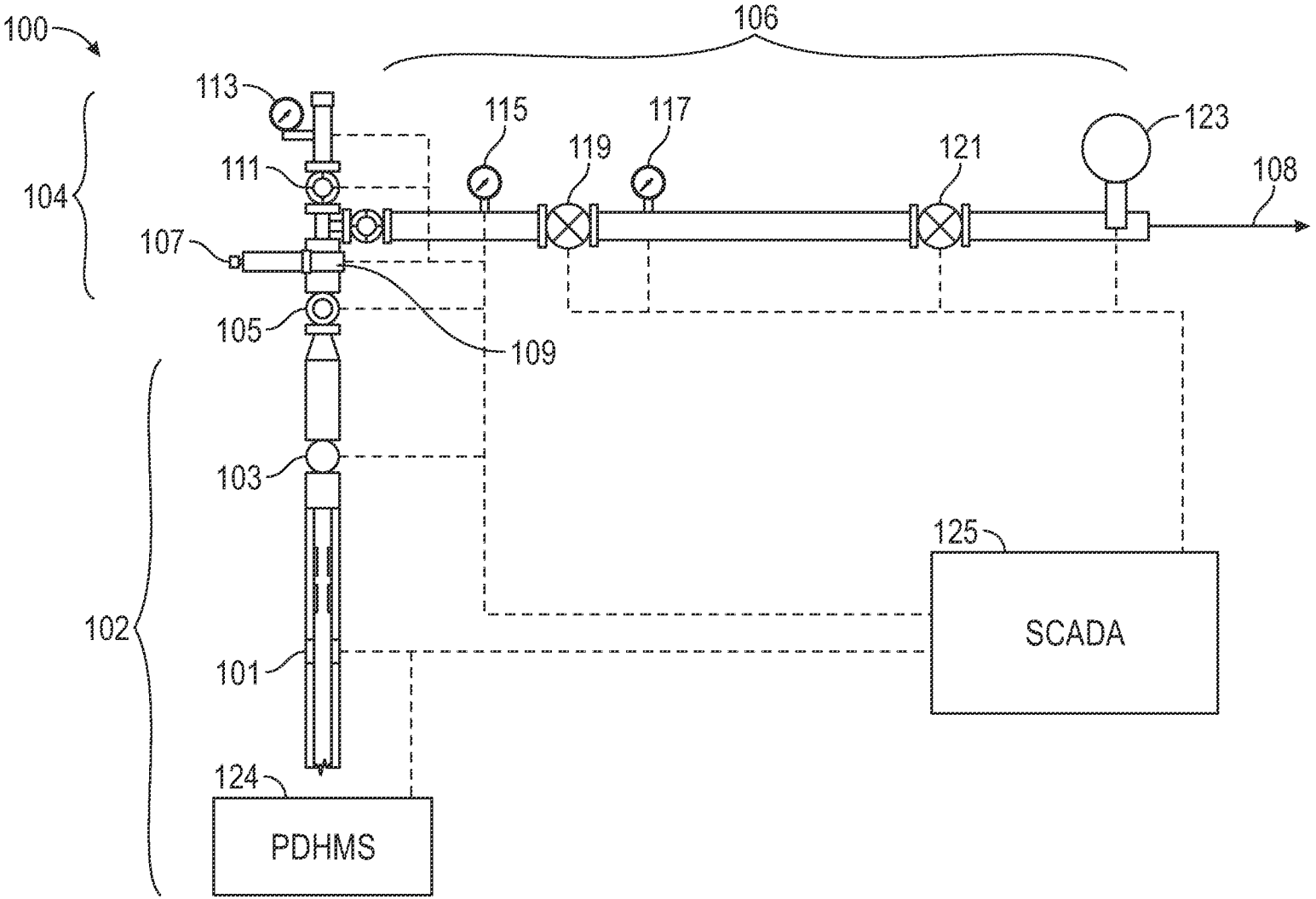
FIG. 1 depicts a pipeline in accordance with one or more embodiments.

In accordance with one or more embodiments, FIG. 1 depicts a simplified portion of a pipeline (100) of a multilateral well in an oil and gas field. Herein, an oil and gas field is broadly defined to consist of wells which produce at least some oil and/or gas. Hydrocarbon wells typically produce oil, gas, and water in combination. The relative amounts of oil, gas, and water may differ between wells and vary over any one well's lifetime.

For clarity, the pipeline (100) is divided into three sections; namely, a subsurface (102) section, a tree (104) section, and a flowline (106) section. It is emphasized that pipelines (100) and other components of wells and, more generally, oil and gas fields may be configured in a variety of ways. As such, one with ordinary skill in the art will appreciate that the simplified view of FIG. 1 does not impose a limitation on the scope of the present disclosure. As part of the subsurface (102) section, FIG. 1 shows an inflow control valve (ICV) (101). An ICV (101) is an active component usually installed during well completion. The ICV (101) may partially or completely choke flow into a well. Generally, multiple ICVs (101) are installed along the reservoir section of a wellbore. Each ICV (101) is separated from the next by a packer. Each ICV (101) can be adjusted and controlled to alter flow within in the well and, as the reservoir depletes, prevent unwanted fluids from entering the wellbore. The subsurface (102) section of the pipeline (100) has a subsurface safety valve (SSSV) (103). The SSSV (103) is designed to close and completely stop flow in the event of an emergency. Generally, an SSSV (103) is designed to close on failure. That is, the SSSV (103) requires a signal to stay open and loss of the signal results in the closing of the valve. Also shown as part of the subsurface (102) section is a permanent downhole monitoring system (PDHMS) (124). The PDHMS (124) consists of a plurality of sensors, gauges, and controllers to monitor subsurface flowing and shut-in pressures and temperatures. As such, a PDHMS (124) may indicate, in real-time, the state or operating condition of subsurface equipment and the fluid flow.

Turning to the tree (104) section of FIG. 1 is a master valve (MV) (105), a surface safety valve (SSV) (107), and a wing valve (WV) (109). The MV (105) controls all flow from the wellbore. For safety considerations, a MV (105) is usually considered so important that two master valves (MVs) (second not shown) are used wherein one acts as a backup. Like unto the SSSV (103), the SSV (107) is a valve installed on the upper portions of the wellbore to provide emergency closure and stoppage of flow. Again, SSVs (107) are designed to close on failure. One or more WVs (109) may be located on the side of the tree (104) section, or on temporary surface flow equipment (not shown). WVs (109) may be used to control and isolate production fluids and/or be used for treatment or well-control purposes.

Also shown in FIG. 1 is a control valve (CV) (111) and a pressure gauge (PG) (113). The CV (111) is a valve that controls a process variable, such as pressure, flow, or temperature, by modulating its opening. The PG (113) monitors the fluid pressure at the tree (104) section.

Turning to the flowline (106) section, the flowline (106) transports (108) the fluid from the well to a storage or processing facility (not shown). A choke valve (119) is disposed along the flowline (106). The choke valve (119) is used to control flow rate and reduce pressure for processing the extracted fluid at a downstream processing facility. In particular, effective use of the choke valve (119) prevents damage to downstream equipment and promotes longer periods of production without shut-down or interruptions. The choke valve (119) is bordered by an upstream pressure transducer (115) and a downstream pressure transducer (117) which monitor the pressure of the fluid entering and exiting the choke valve (119), respectively. The flowline (106) shown in FIG. 1 has a block and bleed valve system (121) which acts to isolate or block the flow of fluid such that it does not reach other downstream components. The flowline (106) may be configured with a multiphase flow meter (MPFM) (123). The MPFM (123) monitors the flow rate of fluid by constituent. That is, the MPFM (123) may detect the instantaneous amount of gas, oil, and water. As such, the MPFM (123) indicates percent water cut (% WC) and the gas-to-oil ratio (GOR). Additionally, the MPFM (123) may measure pressure and fluid density.

The various valves, pressure gauges and transducers, sensors, and flow meters depicted in FIG. 1 may be considered devices of an oil and gas field. As shown, these devices may be disposed both above and below the surface of the Earth. These devices are used to monitor and control components and sub-processes of an oil and gas field. It is emphasized that the plurality of oil and gas field devices depicted in FIG. 1 are non-exhaustive. Additional devices, such as electrical submersible pumps (ESPs) (not shown) may be present in an oil and gas field with their associated sensing and control capabilities. For example, an ESP may monitor the temperature and pressure of a fluid local to the ESP and may be controlled through adjustments to ESP speed or frequency.

The plurality of oil and gas field devices may be distributed, local to the sub-processes and associated components, global, connected, etc. The devices may be of various control types, such as a programmable logic controller (PLC) or a remote terminal unit (RTU). For example, a programmable logic controller (PLC) may control valve states, pipe pressures, warning alarms, and/or pressure releases throughout the oil and gas field. In particular, a programmable logic controller (PLC) may be a ruggedized computer system with functionality to withstand vibrations, extreme temperatures, wet conditions, and/or dusty conditions, for example, around a pipeline (100). With respect to an RTU, an RTU may include hardware and/or software, such as a microprocessor, that connects sensors and/or actuators using network connections to perform various processes in the automation system. As such, a distributed control system may include various autonomous controllers (such as remote terminal units) positioned at different locations throughout the oil and gas field to manage operations and monitor sub-processes. Likewise, a distributed control system may include no single centralized computer for managing control loops and other operations.

In accordance with one or more embodiments, FIG. 1 depicts a supervisory control and data acquisition (SCADA) system (125). A SCADA system (125) is a control system that includes functionality for device monitoring, data collection, and issuing of device commands. The SCADA system (125) enables local control at an oil and gas field as well as remote control from a control room or operations center. To emphasize that the SCADA system (125) may monitor and control the various devices of an oil and gas field, dashed lines connecting the plurality of oil and gas field devices to the SCADA system (125) are shown in FIG. 1.

Oil and gas field devices, like those shown in FIG. 1 (and others not shown), monitor and govern the behavior of the components and sub-processes of the oil and gas field. Therefore, the productivity of the oil and gas field is directly affected, and may be altered, by the devices. Generally, complex interactions between oil and gas field components and sub-process exist such that configuring field devices for optimal production is a difficult and laborious task. Further, the state and behavior of oil and gas fields is transient over the lifetime of the constituent wells requiring continual changes to the field devices to enhance production. In one aspect, embodiments disclosed herein relate to a system for determining the settings for the inflow control valves (ICVs) (101) and choke valves (119) of an oil and gas field such that the oil and gas field production is optimized. Oil and gas production is said to be optimized by reducing the water cut at the minimum drawdown pressure for a given production rate. The optimal ICV (101) and choke valve (119) settings are determined with a machine-learned model taking into consideration the current state of the oil and gas field as monitored by the plurality of oil and gas field devices. In accordance with one or more embodiments, the ICV (101) and choke valve (119) settings may be adjusted automatically, and in real-time, through a control system, such as the SCADA system (125).

In accordance with one or more embodiments, data from the oil and gas field devices are processed with a machine-learned model to determine the optimal ICV (101) and choke valve (119) settings for the oil and gas field. Machine learning, broadly defined, is the extraction of patterns and insights from data. The phrases "artificial intelligence", "machine learning", "deep learning", and "pattern recognition" are often convoluted, interchanged, and used synonymously throughout the literature. This ambiguity arises because the field of "extracting patterns and insights from data" was developed simultaneously and disjointedly among a number of classical arts like mathematics, statistics, and computer science. For consistency, the term machine learning, or machine-learned, will be adopted herein, however, one skilled in the art will recognize that the concepts and methods detailed hereafter are not limited by this choice of nomenclature.

Machine-learned model types may include, but are not limited to, neural networks, random forests, generalized linear models, and Bayesian regression. Further, as defined herein, machine learning may include algorithmic search methods and optimization methods such as a line search or the genetic algorithm. Machine-learned model types are usually associated with additional "hyperparameters" which further describe the model. For example, hyperparameters providing further detail about a neural network may include, but are not limited to, the number of layers in the neural network, choice of activation functions, inclusion of batch normalization layers, and regularization strength. The selection of hyperparameters surrounding a model is referred to as selecting the model "architecture". Generally, multiple model types and associated hyperparameters are tested and the model type and hyperparameters that yield the greatest predictive performance on a hold-out set of data is selected.

As noted, the objective of the machine-learned model is to determine the optimal settings for ICVs (101) and choke valves (119) in an oil and gas field. In accordance with one or more embodiments, FIG. 2 depicts the interactions between the machine-learned model (206), the input data, desired outputs, and the SCADA (125) system.

As seen, oil and gas field device data (202) are collected from the plurality of devices of the oil and gas field. The device data (202) may include measurements of temperature, pressure, percent water cut (% WC), and gas-to-oil ratio (GOR) from one or more multiphase flow meters (123) disposed throughout the oil and gas field. Likewise, subsurface measurements, such as temperature and pressure, may be collected and received from a permanent downhole monitoring system (PDHMS) (124). The device data (202) may further include frequency, speed, pressure, and temperature measurements from one or more electrical submersible pumps (ESPs), pressure readings from a plurality of pressure transducers (115, 117), and pressure, temperature, and valve states at the tree (104) section. Additionally, the device data (202) includes the current settings of the ICVs (101) and choke valves (119) of the oil and gas field. Finally, the device data (202) includes monitoring of the oil and gas production such that it may be determined when oil and gas production is optimized. One with ordinary skill in the art will appreciate that additional field devices may be employed in an oil and gas field and that additional associated device data (202) may be collected without departing from the scope of this disclosure.

Figure 2:
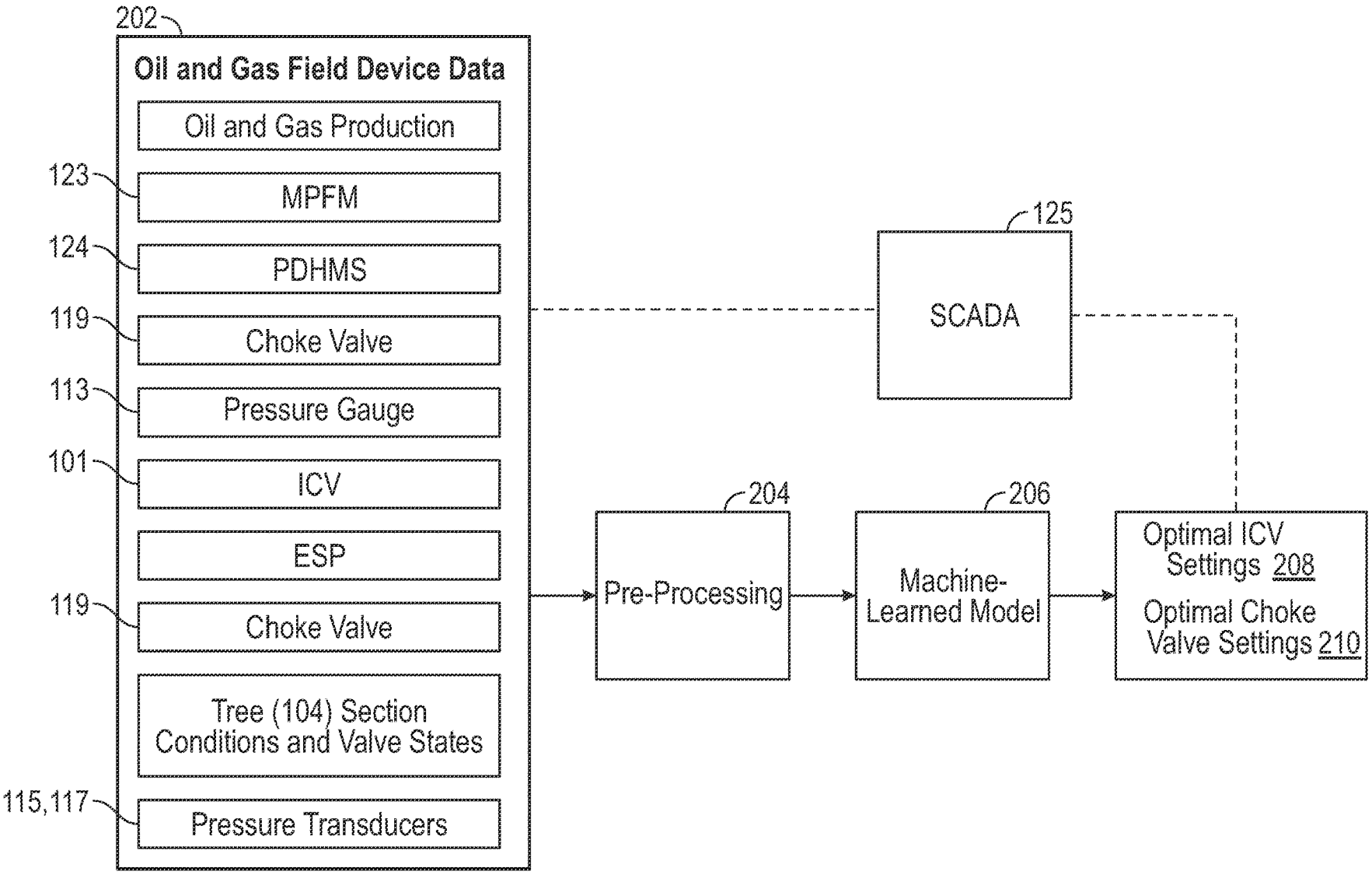
FIG. 2 depicts a system in accordance with one or more embodiments.

In accordance with one or more embodiments, and as shown in FIG. 2, the device data (202) may be pre-processed (204) before being processed by the machine-learned model (206). Pre-processing (204) may include activities such as, numericalization, filtering and/or smoothing of the device data (202), scaling (e.g.; normalization) of the device data (202), feature selection, and feature engineering. Feature selection comprises identifying and selecting a subset of device data (202) with the greatest discriminative power with respect to determining the optimal ICV (101) and choke valve (119) settings. For example, in one embodiment, discriminative power may be quantified by calculating the strength of correlation between elements of the device data (202) and the ICV (101) and choke valve (119) settings. Consequently, in some embodiments, not all of the device data (202) need be passed to the machine-learned model (206). Feature engineering encompasses combining, or processing, various device data (202) to create derived quantities. The derived quantities are processed by the machine-learned model (206). For example, the device data (202) may be processed by one or more "basis" functions such as a polynomial basis function or a radial basis function. In some embodiments, the device data (202) is passed to the machine-learned model (206) without pre-processing (204). Many additional pre-processing (204) techniques and basis functions exist such that one with ordinary skill in the art would not interpret those listed here as a limitation on the present disclosure.

The pre-processed (204) device data (202), which may be identical to the original device data (202) or contain derived features or a sub-selection of features, is processed by the machine-learned model (206). The machine-learned model (206) is configured to output optimal ICV (208) and choke valve (210) settings. The optimal settings are those which, if applied, will result in the optimal oil and gas production as determined by the machine-learned model (206).

As shown in FIG. 2, the device data (202) and the optimal settings (208, 210), as output by the machine-learned model are integrated into the SCADA (125) system. In accordance with one or more embodiments, upon receiving the optimal settings (208, 210) from the machine-learned model (206), the SCADA (125) system may automatically adjust the ICV (101) and choke valve (119) settings to the optimal values (208, 210). In another embodiment, the optimal settings (208, 210) are reviewed by a subject matter expert or control operator and the ICV (101) and choke valve (119) settings are adjusted manually. Oil and gas production, as monitored by at least one device from the plurality of oil and gas field devices, and collected as device data (202), is continuously monitored to ensure that the accepted ICV (101) and choke valve (119) settings maintain the oil and gas field at optimal production.

Figure 3A:
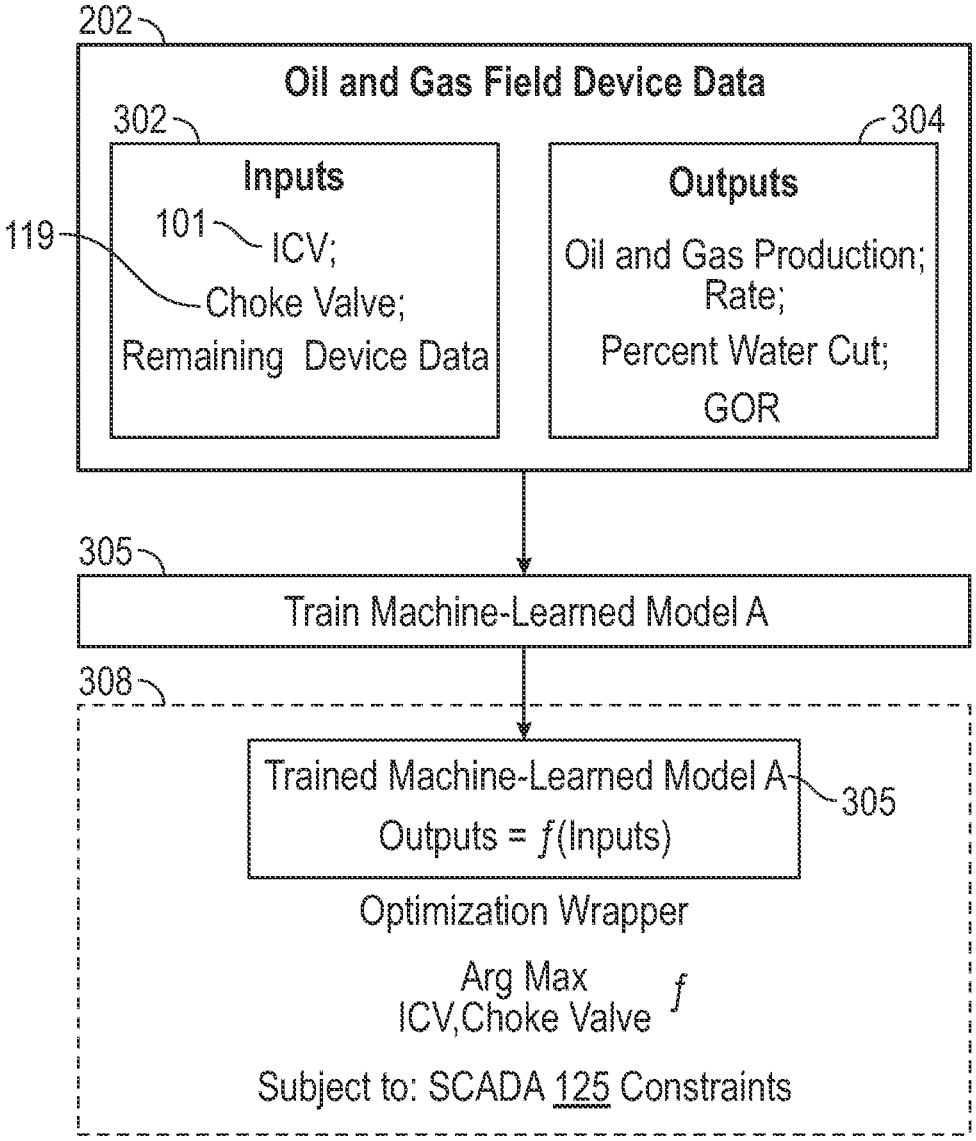
FIG. 3A depicts a machine-learned model framework in accordance with one or more embodiments.
Figure 3B:
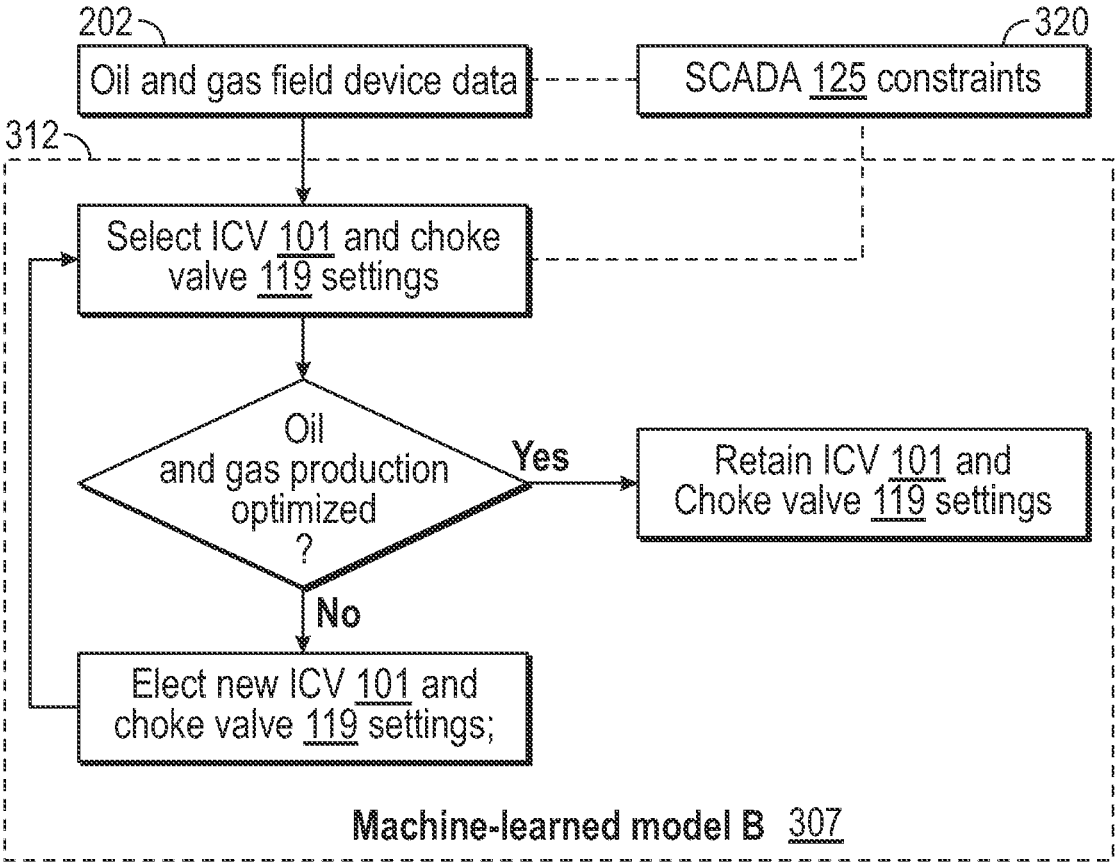
FIG. 3B depicts a machine-learned model framework in accordance with one or more embodiments.

FIG. 3A depicts an embodiment of using collected device data (202) to determine the optimal ICV settings (208) and the optimal choke valve settings (210). As shown in FIG. 3A, the device data (202) is partitioned into "inputs" (302) and "outputs" (304). The outputs include device data (202) representative of oil and gas production such as the percent water cut (% WC) and the gas-to-oil ratio (GOR) at a given flow rate. The inputs include the current ICV (101) and choke valve (119) settings and any other device data (202) retained, or derived quantities created, after pre-processing (204). The device data (202) may be collected over a period of time or may be acquired from analogous oil and gas fields. The collected device data (202), partitioned into inputs (302) and outputs (304), are used to train a machine-learned model A (305). The machine-learned model A (305) may be of any type known in the art. In some embodiments, multiple machine-learned model types and/or architectures may be used. Generally, the machine-learned model type and architecture with the greatest performance on a set of hold-out data is selected. Greater detail surrounding the training procedure for a machine-learned model (206) will be provided below in the context of a neural network. However, generally, training a machine-learned model (206) involves processing data to develop a functional relationship between elements of the data. The result of the training procedure is a trained machine-learned model A (305). The trained machine-learned model A (305) may be described as a function relating the inputs (302) and the outputs (304). That is, the machine learned model A (305) may be mathematically represented as outputs=$f$(inputs), such that given an input (302) the machine-learned model (305) may produce an output (304). With a trained machine-learned model A (305), an optimization wrapper (depicted as Block 308) is used to invert the model to determine the ICV (101) and choke valve (119) settings which optimize oil and gas production. Mathematically, the optimization takes the form $$\underset{ICV,\ Choke\ Valve}{\operatorname{argmax}}\ f \tag{1}$$

subject to: *SCADA* (125) constraints, where the machine learned model A (305), represented by the function $f$, is maximized with respect to the ICV (101) and choke valve (119) settings subject to oil and gas field constraints. One with ordinary skill in the art will appreciate that maximization and minimization may be made equivalent through simple techniques such as negation. As such, the choice to represent the optimization as a maximization as shown in EQ. 1 does not limit the scope of the present disclosure. Whether done through minimization or maximization, the optimization wrapper (308) identifies the ICV (101) and choke valve (119) values which optimize oil and gas production according to the trained machine-learned model A (305). An oil and gas field may be subject to constraints, such as safety limits imposed on various devices and sub-processes of an oil and gas field. For example, it may be determined that in order for an oil and gas field to operate safely, pressure, as measured by a given field device, should not exceed a prescribed value. In the embodiment described by FIG. 3, the device data (202) is monitored by the SCADA (125) system such that device and process limits are monitored and controlled by the SCADA (125) system. The optimization wrapper (308) cannot elect ICV (101) and choke valve (119) settings which cause any portion of the oil and gas field to exceed pre-defined constraints. FIG. 3B depicts another embodiment of the machine-learned model (206). In this embodiment, the device data (202) is passed to machine-learned model B (307). The machine-learned model B (307) performs various operations, encompassed by Block 312, described as follows. The machine-learned model B (307) selects ICV (101) and choke valve (119) settings. The machine-learned model B (307) using the oil and gas production data of the device data (202) checks if the oil and gas field is operating at optimal conditions. If the oil and gas production is optimal the ICV (101) and choke valve (119) settings are retained. If the oil and gas production is sub-optimal, the machine-learned model B (307) intelligently elects new ICV (101) and choke valve (119) settings. The new settings may be intelligently elected through any known method in the art, such as a grid search to probe various ICV (101) and choke valve (119) settings in search for the optimal settings.

Other intelligent search methods, or the machine learned model B (307), may include a genetic algorithm, Bayesian search, or a Gaussian process. For example, while a full description of a Gaussian process exceeds the scope of this disclosure, it may simply be said that a Gaussian process is a machine-learned method, which in the present case may be used to construct a relationship between oil and gas production and ICV (101) and choke valve (119) settings given the remaining device data (202). Such a relationship may be mathematically described as $$\vec{y}=f(\vec{x}|D)\sim N(\ ), \tag{2}$$

where $\vec{y}$ is a vector of quantities indicating oil and gas production, $\vec{x}$ is a vector of ICV (101) and choke valve (119) settings, and D is the remaining pre-processed device data (202). The output $\vec{y}$ of a Gaussian process for a given input $\vec{x}$ will follow a normal distribution with a mean value and a variance. Because the outputs of a Gaussian process follow a normal distribution, the Gaussian process naturally lends itself to uncertainty quantification. As such, the domain of inputs $\vec{x}$ may be intelligently searched to discover the optimal outputs $\vec{y}$ within the bounds of uncertainty.

Once elected, the new ICV (101) and choke valve (119) settings are selected and used in the oil and gas field. This process is repeated until the optimal settings have been discovered. Again, like the embodiment of FIG. 3A, the device data (202) is continuously monitored by the SCADA (125) system, and all ICV (101) and choke valve settings (119) are subjected to any pre-defined system constraints as depicted by Block 320.

In accordance with one or more embodiments, the procedures depicted in FIGS. 3A and 3B may be combined and/or used in complimentary fashion. For example, the search method of machine-learned model B (307) could be used as the optimization wrapper (308) of the embodiment shown in FIG. 3A. In another embodiment, the procedure of FIG. 3B is used to efficiently probe the domain of inputs and record the associated device data (202) to generate robust training data for the machine-learned model A (305).

Figure 4:
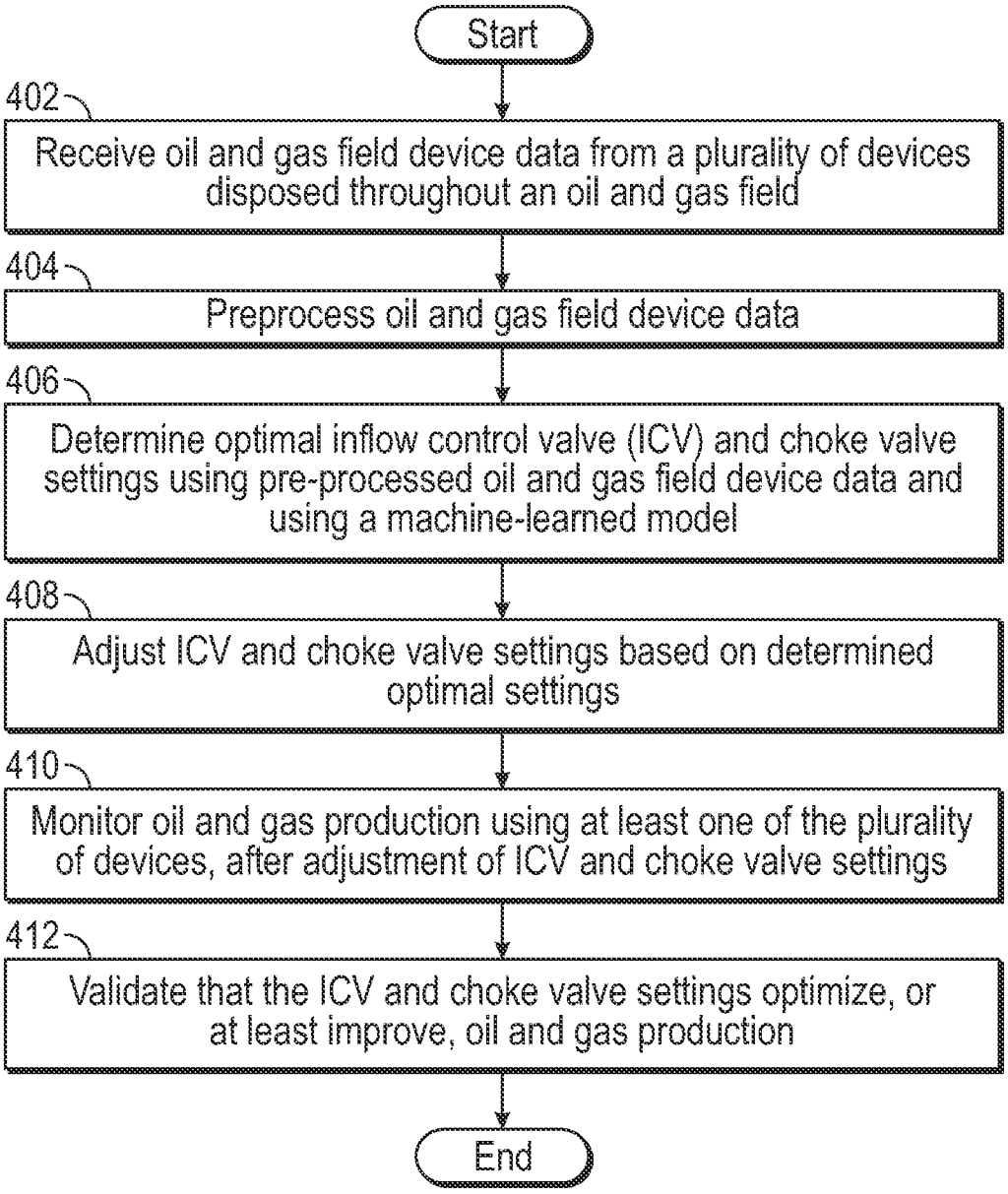
FIG. 4 depicts a flowchart in accordance with one or more embodiments.

The process of using the device data (202) to determine the ICV (101) and choke valve (119) settings which optimize the oil and gas production of an oil and gas field is summarized in the flow chart of FIG. 4. According to Block 402, oil and gas field device data (202) is received. The oil and gas field device data (202) may include measurements from a plurality of devices disposed throughout the oil and gas field. The devices may include various valves which control the flow of fluid throughout the oil and gas field and sensors which measure and quantify the state of various components of the system. The oil and gas field device data (202) may be pre-processed as shown in Block 404. Pre-processing may include numericalizing the data, scaling the data, selecting features from the data, and engineering features from the data. A machine-learned model type(s) and associated architecture(s) are selected. In Block 406, once pre-processed, the device data (202) is processed with a machine-learned model (206) to determine the optimal ICV (101) and choke valve (119) settings. Various embodiments of the machine-learned model have been described in FIGS. 3A and 3B. The machine-learned model (206) outputs ICV (101) and choke valve (119) settings which if implemented, according to the machine-learned model (206) will optimize oil and gas production in the oil and gas field. Oil and gas production is said to be optimized by reducing the percent water cut (% WC) at the minimum drawdown pressure for a given production rate. In Block 408, the ICV (101) and choke valve (119) settings are adjusted to their optimal values as returned by the machine-learned model (206). This adjustment may be performed automatically and autonomously, or may be done manually, or may be checked by a "human-in-the-loop." Once the ICV (101) and choke valve (119) settings have been adjusted the oil and gas production is monitored by at least one field device from the plurality of oil and gas field devices, as depicted in Block 410. By monitoring the oil and gas production before and after the adjustment of ICV (101) and choke valve (119) settings, the effect of the adjustment on the oil and gas production may be quantified. As such, as shown in Block 412, the adjusted ICV (101) and choke valve (119) settings may be validated. If the adjusted ICV (101) and choke valve (119) settings are not found to improve the oil and gas production, the original ICV (101) and choke valve (119) settings may be restored. In this case, a new machine-learned model (206) may be selected, or the machine-learned model (206) may be re-trained with additional device data (202) to output different optimal ICV and choke valve settings.

While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Embodiments of the present disclosure may provide at least one of the following advantages. As noted, complex interactions between oil and gas field components and sub-processes exist such that configuring a plurality of devices for optimal production is a difficult and laborious task. For example, device settings may be adjusted to prevent or mitigate unwanted activities such as coning and cusping. Further, the state and behavior of oil and gas fields is transient over the lifetime of the constituent wells requiring continual changes to the plurality of field devices to enhance production. By continuously receiving and processing device data (202) with a machine-learned model (206), the oil and gas field can be maintained in an optimal state greatly reducing the cost and time required to identify optimal settings which change with the transient nature of the wells. This, in turn, improves oil and gas yield and prolongs the life of constituent wells. Further, optimal choke valve (119) setting serve to prevent damage to downstream equipment and promote longer periods of production without shut-down or interruptions.

Figure 5:
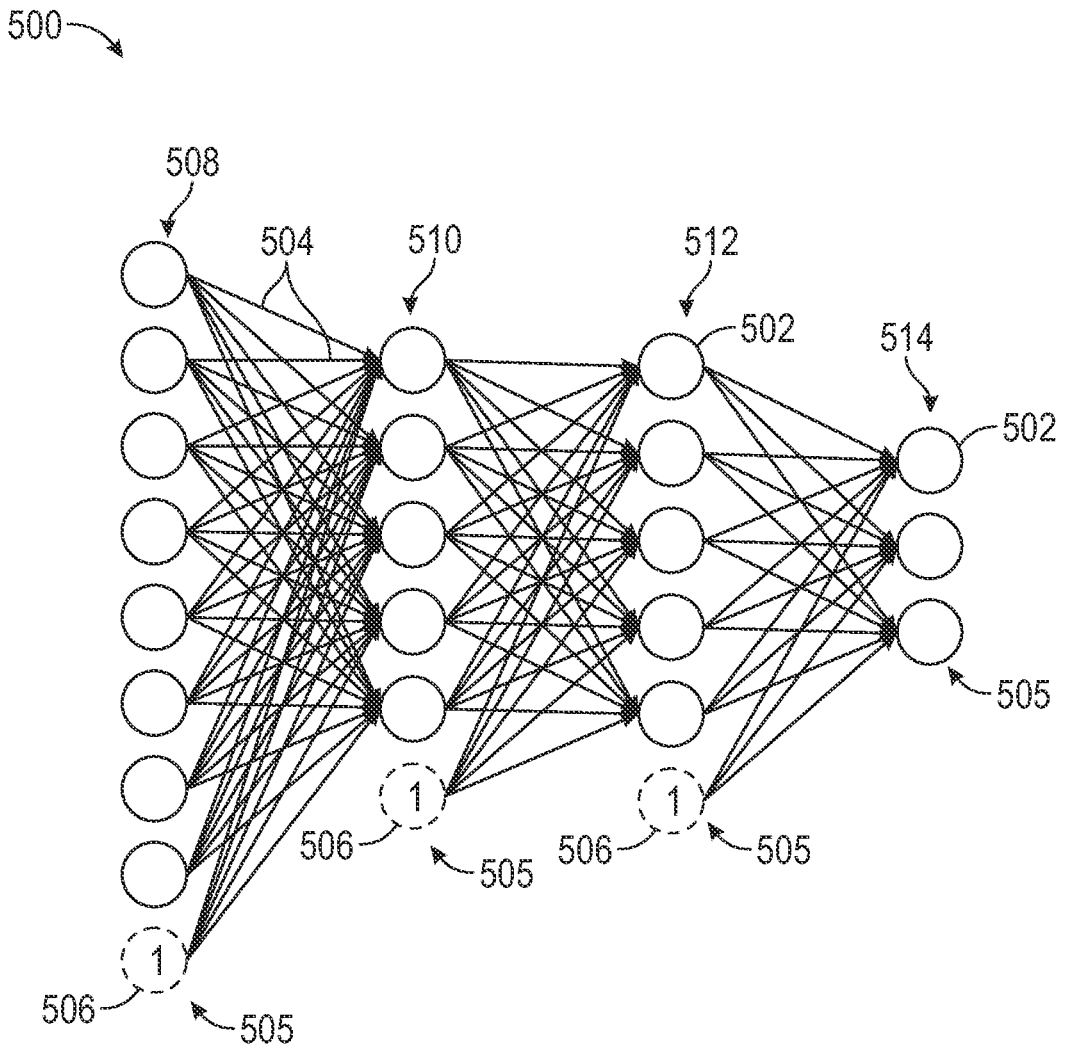
FIG. 5 depicts a neural network in accordance with one or more embodiments.

In accordance with one or more embodiments, one or more of the machine-learned models (206) discussed herein, such as the machine-learned model A (305) is a neural network. A diagram of a neural network is shown in FIG. 5. At a high level, a neural network (500) may be graphically depicted as being composed of nodes (502), where here any circle represents a node, and edges (504), shown here as directed lines. The nodes (502) may be grouped to form layers (505). FIG. 5 displays four layers (508, 510, 512, 514) of nodes (502) where the nodes (502) are grouped into columns, however, the grouping need not be as shown in FIG. 5. The edges (504) connect the nodes (502). Edges (504) may connect, or not connect, to any node(s) (502) regardless of which layer (505) the node(s) (502) is in. That is, the nodes (502) may be sparsely and residually connected. A neural network (500) will have at least two layers (505), where the first layer (508) is considered the "input layer" and the last layer (514) is the "output layer". Any intermediate layer (510, 512) is usually described as a "hidden layer". A neural network (500) may have zero or more hidden layers (510, 512) and a neural network (500) with at least one hidden layer (510, 512) may be described as a "deep" neural network or as a "deep learning method". In general, a neural network (500) may have more than one node (502) in the output layer (514). In this case the neural network (500) may be referred to as a "multi-target" or "multi-output" network.

Nodes (502) and edges (504) carry additional associations. Namely, every edge is associated with a numerical value. The edge numerical values, or even the edges (504) themselves, are often referred to as "weights" or "parameters". While training a neural network (500), numerical values are assigned to each edge (504). Additionally, every node (502) is associated with a numerical variable and an activation function. Activation functions are not limited to any functional class, but traditionally follow the form $$A=f(\Sigma_{i\in(incoming)}[(\text{node value})_i(\text{edge value})_i]), \quad (3),$$

where i is an index that spans the set of "incoming" nodes (502) and edges (504) and $f$ is a user-defined function. Incoming nodes (502) are those that, when viewed as a graph (as in FIG. 5), have directed arrows that point to the node (502) where the numerical value is being computed. Some functions for $f$ may include the linear function $f(x)=x$, sigmoid function $$f(x) = \frac{1}{1+e^{-x}},$$

and rectified linear unit function $f(x)=\max(0, x)$, however, many additional functions are commonly employed. Every node (502) in a neural network (500) may have a different associated activation function. Often, as a shorthand, activation functions are described by the function $f$ by which it is composed. That is, an activation function composed of a linear function $f$ may simply be referred to as a linear activation function without undue ambiguity.

When the neural network (500) receives an input, the input is propagated through the network according to the activation functions and incoming node (502) values and edge (504) values to compute a value for each node (502). That is, the numerical value for each node (502) may change for each received input. Occasionally, nodes (502) are assigned fixed numerical values, such as the value of 1, that are not affected by the input or altered according to edge (504) values and activation functions. Fixed nodes (502) are often referred to as "biases" or "bias nodes" (506), displayed in FIG. 5 with a dashed circle.

In some implementations, the neural network (500) may contain specialized layers (505), such as a normalization layer, or additional connection procedures, like concatenation. One skilled in the art will appreciate that these alterations do not exceed the scope of this disclosure.

As noted, the training procedure for the neural network (500) comprises assigning values to the edges (504). To begin training the edges (504) are assigned initial values. These values may be assigned randomly, assigned according to a prescribed distribution, assigned manually, or by some other assignment mechanism. Once edge (504) values have been initialized, the neural network (500) may act as a function, such that it may receive inputs and produce an output. As such, at least one input is propagated through the neural network (500) to produce an output. Recall, that a given data set will be composed of inputs and associated target(s), where the target(s) represent the "ground truth", or the otherwise desired output. The neural network (500) output is compared to the associated input data target(s). The comparison of the neural network (500) output to the target(s) is typically performed by a so-called "loss function"; although other names for this comparison function such as "error function", "misfit function", and "cost function" are commonly employed. Many types of loss functions are available, such as the mean-squared-error function, however, the general characteristic of a loss function is that the loss function provides a numerical evaluation of the similarity between the neural network (500) output and the associated target(s). The loss function may also be constructed to impose additional constraints on the values assumed by the edges (504), for example, by adding a penalty term, which may be physics-based, or a regularization term. Generally, the goal of a training procedure is to alter the edge (504) values to promote similarity between the neural network (500) output and associated target(s) over the data set. Thus, the loss function is used to guide changes made to the edge (504) values, typically through a process called "backpropagation".

While a full review of the backpropagation process exceeds the scope of this disclosure, a brief summary is provided. Backpropagation consists of computing the gradient of the loss function over the edge (504) values. The gradient indicates the direction of change in the edge (504) values that results in the greatest change to the loss function. Because the gradient is local to the current edge (504) values, the edge (504) values are typically updated by a "step" in the direction indicated by the gradient. The step size is often referred to as the "learning rate" and need not remain fixed during the training process. Additionally, the step size and direction may be informed by previously seen edge (504) values or previously computed gradients. Such methods for determining the step direction are usually referred to as "momentum" based methods.

Once the edge (504) values have been updated, or altered from their initial values, through a backpropagation step, the neural network (500) will likely produce different outputs. Thus, the procedure of propagating at least one input through the neural network (500), comparing the neural network (500) output with the associated target(s) with a loss function, computing the gradient of the loss function with respect to the edge (504) values, and updating the edge (504) values with a step guided by the gradient, is repeated until a termination criterion is reached. Common termination criteria are: reaching a fixed number of edge (504) updates, otherwise known as an iteration counter; a diminishing learning rate; noting no appreciable change in the loss function between iterations; reaching a specified performance metric as evaluated on the data or a separate hold-out data set. Once the termination criterion is satisfied, and the edge (504) values are no longer intended to be altered, the neural network (500) is said to be "trained".

While multiple embodiments using different machine-learned models (206) have been suggested, one skilled in the art will appreciate that this process, of determining the optimal ICV (101) and choke valve (119) settings, is not limited to the listed machine-learned models. Machine-learned models (206) such as a random forest, support vector machines, or non-parametric methods such as K-nearest neighbors may be readily inserted into this framework and do not depart from the scope of this disclosure.

Figure 6:
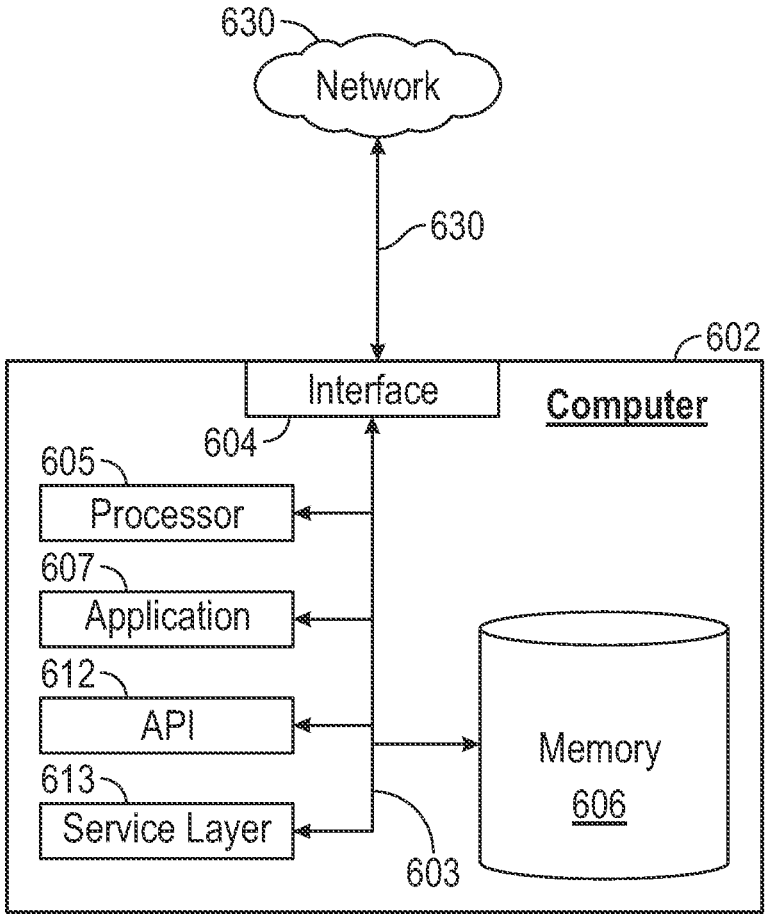
FIG. 6 depicts a system in accordance with one or more embodiments.

Embodiments may be implemented on a computer system. FIG. 6 is a block diagram of a computer system (602) used to provide computational functionalities associated with described algorithms, methods, functions, processes, flows, and procedures as described in the instant disclosure, according to one or more embodiments. The illustrated computer (602) is intended to encompass any computing device such as a server, desktop computer, laptop/notebook computer, wireless data port, smart phone, personal data assistant (PDA), tablet computing device, one or more processors within these devices, or any other suitable processing device such as an edge computing device, including both physical or virtual instances (or both) of the computing device. An edge computing device is a dedicated computing device that is, typically, physically adjacent to the process or control with which it interacts. For example, the machine-learned model (206) may be implemented on an edge computing device in order to quickly provide optimal ICV settings (208) and choke valve settings (210) to nearby ICVs and choke valves, or their controllers. Additionally, the computer (602) may include a computer that includes an input device, such as a keypad, keyboard, touch screen, or other device that can accept user information, and an output device that conveys information associated with the operation of the computer (602), including digital data, visual, or audio information (or a combination of information), or a GUI.

The computer (602) can serve in a role as a client, network component, a server, a database or other persistency, or any other component (or a combination of roles) of a computer system for performing the subject matter described in the instant disclosure. In some implementations, one or more components of the computer (602) may be configured to operate within environments, including cloud-computing-based, local, global, or other environment (or a combination of environments).

At a high level, the computer (602) is an electronic computing device operable to receive, transmit, process, store, or manage data and information associated with the described subject matter. According to some implementations, the computer (602) may also include or be communicably coupled with an application server, e-mail server, web server, caching server, streaming data server, business intelligence (BI) server, or other server (or a combination of servers).

The computer (602) can receive requests over network (630) from a client application (for example, executing on another computer (602) and responding to the received requests by processing the said requests in an appropriate software application. In addition, requests may also be sent to the computer (602) from internal users (for example, from a command console or by other appropriate access method), external or third-parties, other automated applications, as well as any other appropriate entities, individuals, systems, or computers.

Each of the components of the computer (602) can communicate using a system bus (603). In some implementations, any or all of the components of the computer (602), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (602) or other components (whether or not illustrated) that are communicably coupled to the computer (602). The functionality of the computer (602) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or another suitable format. While illustrated as an integrated component of the computer (602), alternative implementations may illustrate the API (612) or the service layer (613) as stand-alone components in relation to other components of the computer (602) or other components (whether or not illustrated) that are communicably coupled to the computer (602). Moreover, any or all parts of the API (612) or the service layer (613) may be implemented as child or sub-modules of another software module, enterprise application, or hardware module without departing from the scope of this disclosure.

The computer (602) includes an interface (604). Although illustrated as a single interface (604) in FIG. 6, two or more interfaces (604) may be used according to particular needs, desires, or particular implementations of the computer (602). The interface (604) is used by the computer (602) for communicating with other systems in a distributed environment that are connected to the network (630). Generally, the interface (604) includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (602).

The computer (602) includes at least one computer processor (605). Although illustrated as a single computer processor (605) in FIG. 6, two or more processors may be used according to particular needs, desires, or particular implementations of the computer (602). Generally, the computer processor (605) executes instructions and manipulates data to perform the operations of the computer (602) and any algorithms, methods, functions, processes, flows, and procedures as described in the instant disclosure.

The computer (602) also includes a memory (606) that holds data for the computer (602) or other components (or a combination of both) that can be connected to the network (630). The memory may be a non-transitory computer readable medium. For example, memory (606) can be a database storing data consistent with this disclosure. Although illustrated as a single memory (606) in FIG. 6, two or more memories may be used according to particular needs, desires, or particular implementations of the computer (602) and the described functionality. While memory (606) is illustrated as an integral component of the computer (602), in alternative implementations, memory (606) can be external to the computer (602).

The application (607) is an algorithmic software engine providing functionality according to particular needs, desires, or particular implementations of the computer (602), particularly with respect to functionality described in this disclosure. For example, application (607) can serve as one or more components, modules, applications, etc. Further, although illustrated as a single application (607), the application (607) may be implemented as multiple applications (607) on the computer (602). In addition, although illustrated as integral to the computer (602), in alternative implementations, the application (607) can be external to the computer (602).

There may be any number of computers (602) associated with, or external to, a computer system containing computer (602), wherein each computer (602) communicates over network (630). Further, the term "client," "user," and other appropriate terminology may be used interchangeably as appropriate without departing from the scope of this disclosure. Moreover, this disclosure contemplates that many users may use one computer (602), or that one user may use multiple computers (602).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method to optimize an oil and gas field, comprising:

receiving, by a computer processor, oil and gas field device data from a plurality of devices disposed throughout the oil and gas field, the device data comprising oil and gas production data, inflow control valve (ICV) settings, and choke valve setting;

training, by the computer processor, a machine-learned model to receive, as input, the device data and output optimal ICV settings and optimal choke valve settings that optimize the oil and gas production data;

determining, by the computer processor and the trained machine-learned model, the optimal ICV settings and optimal choke valve settings based on the device data; and adjusting, by the computer processor, the ICV settings and choke valve settings to the optimal ICV settings and optimal choke valve settings, respectively.

2. The method of claim 1, further comprising:

pre-processing, by the computer processor, the device data, wherein pre-processing comprises combining the device data to create derived quantities using one or more basis functions.

3. The method of claim 1, further comprising:

selecting, for the machine-learned model, a machine-learned model type and an architecture; and altering the machine-learned model type and/or architecture, or re-training the machine-learned model if the optimal ICV settings and optimal choke valve settings as determined by the machine-learned model are not found to optimize oil and gas production.

4. The method of claim 3, wherein:

the machine-learned model is trained using a data set;

the data set is generated, using an intelligent search, by probing ICV settings and choke valve settings and monitoring the oil and gas production data.

5. The method of claim 1, wherein the machine-learned model is a neural network.

6. The method of claim 1, wherein the oil and gas production data comprises a percent water cut and a production rate.

7. The method of claim 1, wherein the ICV settings and choke valve settings are adjusted automatically by a control system.

8. The method of claim 1, wherein:

the plurality of devices comprises:

a multiphase flow meter, a permanent downhole monitoring system, a temperature transducer at a tree section of a well of the oil and gas field, and a pressure transducer at the tree section;

the device data further comprises:

a first temperature measurement, a first pressure measurement, a percent water cut, and a gas-to-oil ratio from the multiphase flow meter, a second pressure measurement and a second temperature measurement from the pressure transducer and temperature transducer, respectively, at the tree section, and a subsurface temperature measurement and a subsurface pressure measurement from the permanent downhole monitoring system.

9. The method of claim 1, further comprising a supervisory control and data acquisition (SCADA) system that consolidates and displays the device data and controls the plurality of devices.

10. The method of claim 9, wherein the SCADA system disallows ICV settings and choke valve settings that violate oil and gas field constraints.

11. A non-transitory computer readable medium storing instructions executable by a computer processor, the instructions comprising functionality for:

receiving oil and gas field device data from a plurality of devices disposed throughout an oil and gas field, the device data comprising oil and gas production data, inflow control valve (ICV) settings, and choke valve settings;

training a machine-learned model to receive, as input, the device data and output optimal ICV settings and optimal choke valve settings that optimize the oil and gas production data;

determining, by the trained machine-learned model, the optimal ICV settings and optimal choke valve settings based on the device data; and adjusting the ICV settings and choke valve settings to the optimal ICV settings and optimal choke valve settings, respectively.

12. The non-transitory computer readable medium of claim 11, further comprising instructions for:

pre-processing, by the computer processor, the device data, wherein pre-processing comprises combining the device data to create derived quantities using at least one basis function.

13. The non-transitory computer readable medium of claim 11, further comprising instructions for:

re-training the machine-learned model if the optimal ICV settings and optimal choke valve settings as determined by the machine-learned model are not found to optimize oil and gas production.

14. The non-transitory computer readable medium of claim 11, wherein:

the machine-learned model is trained using a data set;

the data set is generated, using an intelligent search, by probing ICV settings and choke valve settings and monitoring the oil and gas production data.

15. The machine-learned model of claim 11, wherein the machine-learned model is a neural network.

16. The non-transitory computer readable medium of claim 11, wherein the oil and gas production data comprises a percent water cut and a production rate.

17. The non-transitory computer readable medium of claim 11, wherein ICV settings and choke valve settings are adjusted to the optimal ICV settings and optimal choke valve settings automatically by a control system.

18. A system, comprising:

a plurality of devices disposed throughout an oil and gas field, the plurality of devices comprising:

a multiphase flow meter configured to measure oil and gas production data, an inflow control valve (ICV), and a choke valve; and a computer communicably connected to the plurality of devices and comprising:

one or more computer processors, and a non-transitory computer readable medium storing instructions executable by a computer processor, the instructions comprising functionality for:

receiving oil and gas field device data from the plurality of devices, the device data comprising the oil and gas production data, inflow control valve (ICV) settings, and choke valve setting training a machine-learned model to receive, as input, the device data and output optimal ICV settings and optimal choke valve settings that optimize the oil and gas production data;

determining, by the trained machine-learned model, the optimal ICV settings and optimal choke valve settings based on the device data; and adjusting the ICV settings and choke valve settings to the optimal ICV settings and optimal choke valve settings, respectively.

19. The system of claim 18, wherein:

the machine-learned model is trained using a data set;

the data set is generated, using an intelligent search, by probing ICV settings and choke valve settings and monitoring the oil and gas production data.

* * * * *